US006631873B2

(12) United States Patent
Fisher

(10) Patent No.: US 6,631,873 B2
(45) **Date of Patent: *Oct. 14, 2003**

(54) PROTECTION DEVICE TO PREVENT TRAIN INCURSIONS INTO A FORBIDDEN AREA

(76) Inventor: Glen T. Fisher, 142 Jasper Road, Beaconsfield, Quebec H9W 5S1 (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/569,939

(22) Filed: May 12, 2000

(65) Prior Publication Data

US 2002/0033637 A1 Mar. 21, 2002

(51) Int. Cl.[7] ..... B61L 3/00

(52) U.S. Cl. ..... 246/182 B; 246/122 R; 246/167 R; 303/7; 303/20

(58) Field of Search ..... 246/182 B, 122 R, 246/167 R; 303/7, 15, 20

(56) References Cited

U.S. PATENT DOCUMENTS

| | | | | |
|---|---|---|---|---|
| 4,487,060 A | | 12/1984 | Pomeroy | |
| 4,641,892 A | | 2/1987 | Schmid | |
| 4,735,383 A | * | 4/1988 | Corrie | 246/122 R |
| 4,768,740 A | * | 9/1988 | Corrie | 246/122 R |
| 5,006,847 A | * | 4/1991 | Rush et al. | 246/122 R |
| 5,415,369 A | | 5/1995 | Hungate | |
| 5,681,015 A | * | 10/1997 | Kull | 246/182 B |
| 5,685,507 A | * | 11/1997 | Horst et al. | 246/187 A |
| 5,947,423 A | * | 9/1999 | Clifton et al. | 246/167 R |
| 5,950,966 A | * | 9/1999 | Hungate et al. | 246/62 |

FOREIGN PATENT DOCUMENTS

| | | |
|---|---|---|
| CA | 2120454 | 3/1994 |
| GB | 2032668 | 8/1978 |
| WO | WO-9633899 | * 10/1996 |
| WO | WO 99/05015 A | * 2/1999 |

OTHER PUBLICATIONS

Edicab—for high traffic capacity—Aug. 1996—4 pgs.
General Capabilities Union Switch & Signal, Inc.,—Sep. 1999—3pgs.
TrainLink III Proximity Warning System—Jan. 1995—4pgs.
Brochure entitled Digitair End–of–Train Systems.

* cited by examiner

*Primary Examiner*—Jack Lavinder
*Assistant Examiner*—Robert A. Siconolfi
(74) *Attorney, Agent, or Firm*—Schweitzer Cornman Gross & Bondell LLP

(57) ABSTRACT

A protection device for a train is disclosed. The protection device works in conjunction with a remote controlled braking system on the train. The remote controlled braking system includes a transmitter in the locomotive of the train and a receiver located elsewhere on the train, typically on the last car. In an emergency situation the transmitter sends to the receiver over an RF communication link a brake command. When the receiver senses the brake command, it implements it by applying the brakes of the train from the car in which the receiver is placed. When the protection device senses that the train is about to enter a forbidden area, such as failing to obey a stop signal, it sends a brake command over the RF communication link to cause the application of the brakes by the receiver unit.

15 Claims, 4 Drawing Sheets

PROTECTION DEVICE TO PREVENT TRAIN INCURSIONS INTO A FORBIDDEN AREA

FIELD OF THE INVENTION

The invention relates to a protection device for the railroad industry. In particular, the protection device is designed to limit the likelihood of train incursions into a forbidden zone, or beyond a certain boundary, which may contain a hazard such as another train, an open switch, an open lift bridge or a work crew, among others.

BACKGROUND OF THE INVENTION

The movement of trains on railroad tracks is usually controlled by a signaling system that is analogous to the traffic lights used on public streets and highways. One problem with this approach is that compliance with the signal being directed to a particular train is dependent upon the attention of the train operator. If the operator is inattentive, distracted or even unconscious, a signal that requires that the train be stopped may go unnoticed, and this might create a potentially hazardous situation.

Against this background, it clearly appears that there is a need in the industry to provide a protection device that functions automatically in a way to reduce the likelihood of train incursions into a forbidden area or beyond a certain boundary.

SUMMARY OF THE INVENTION

Under the first broad aspect, the invention provides a protection device that is designed to be used in conjunction with a remote-controlled braking system of a train. Such a remote-controlled braking system includes a first functional unit that is mounted in the locomotive of the train and a second functional unit mounted in a car that is either pushed or pulled by the locomotive. The first and the second functional units are connected to one another by a radio frequency (RF) link. Such RF link allows the first functional unit to transmit to the second functional unit a brake command such that the second functional unit can apply the brake of the train. Such remote-controlled braking systems are designed as emergency devices allowing the brake of the train to be applied at a location other than the locomotive if for some reason a brake malfunction develops.

The protection device includes a transmitter that is operative to transmit an RF signal for introduction in the RF link to cause the second functional unit to apply the brake of the train in response to the reception of a brake command by this same second functional unit. Such an application of the brake will cause the train to stop or decelerate. The expression "apply the brake" in the context of this specification means that either braking action of the train is initiated or, in the case that the braking action is already initiated, that braking action is augmented.

Under a specific example of implementation, the protection device is a wayside installation and receives an input from a detector that detects the position of the train relative to a certain boundary that the train is not authorized to cross. For example, the detector can be a proximity detector that is triggered when the train passes close to the detector. Such a proximity detector can be of the type that uses a light beam that is broken when the train passes through the beam. Other possibilities include magnetic detectors, pressure sensors and a wide variety of other devices that can issue a signal when a train passes within a certain detection range.

In conventional railway systems, the detector that detects the position of the train is implemented by an electrical circuit formed of the track rails, a source of signal voltage, a relay energized by the signal voltage and the train itself. The presence of the train shunts the signal voltage, thus releasing the relay and thereby detecting the presence of the train in an allowed track area or its incursion into a forbidden area. Another conventional detector implements wheel counter logic for counting the wheels of the train as it passes by, thus determining when the train has vacated a particular track segment and entered the next one. In another example, the detector is a transponder (a low frequency or radio frequency transmitter and receiver) which replies to a signal from the train when it passes over, by indicating a number or code identifying the position as if it were a signpost.

The protection device can be installed immediately adjacent to the traffic signal. When the traffic signal is enabled to indicate to the train operator that the train should stop, the protection device is also enabled. If the train enters within the detection range of the detector, which indicates that the operator of the train has not seen the signal or is unconscious and cannot obey the signal, the transmitter issues a brake command which is received by the second functional unit and interpreted by the second functional unit in the same way as if this brake command was generated by the first functional unit.

The advantage under this approach is that the protection device can be deployed without any modification to the trains. This is a significant practical advantage over other devices that require installation of components on the trains.

The format of the brake command issued by the transmitter can vary and usually will depend on the particular data communication protocol established for the RF link. In one possible example, the RF link is used to exchange signals having different frequencies, the frequency of the signal conveying information to be transmitted between the two functional units. Under this approach, the brake command is a signal at a specific frequency that indicates to the second functional unit to apply the brakes. Under a different possibility, the signals transferred over the RF link are digital signals. In particular, those signals are coded, each code being represented by a different combination of bits. The introduction of a brake command in the RF link is effected by sending a signal from the transmitter of the protection device which includes the particular combination of bits that would be interpreted by the second functional unit as a command to apply the brakes. Under a more sophisticated communication protocol, the protection device may need to first intercept a communication between the two functional units in order to extract data elements that are necessary to construct the brake command. In particular, such communication protocol may be based on the exchange of data packets, each data packet including the address of the first functional unit (uniquely identifying the sender of the data packet) and the address of the second functional unit (uniquely identifying the receiver of the data packet). Such addressing scheme is used to prevent reception and execution of commands by an entity other than the entity to which the command was originally destined. In particular, when two or more trains operate in close proximity to one another, this addressing scheme avoids situations where the command issued by the first functional unit of one train is received and executed by the second functional unit of another train.

Objectively, when the RF link conveys data packets with an addressing scheme, the protection device needs to receive a data packet such as to extract the address information before constructing the brake command. This may require a modification of the first and second functional units such that an exchange of data packets is effected either continuously or through a triggering mechanism when the train approaches the protection device.

Under a possible variant, the protection device is designed to send a signal in the RF link that is not a direct brake command, rather it is designed to trigger the generation of a brake command by the first functional unit. For instance, the signal issued by the transmitter may stimulate an emergency signal that may be issued from the second functional unit and that is designed, under normal circumstances, to cause the first functional unit to issue a brake command. Thus, the brake command is implemented by the second functional unit or, alternatively, the brake command is implemented by the first functional unit.

Under another variant, the protection device is mounted on the train. The detection of the train position with respect to the unauthorized zone or boundary can be done by a GPS based device.

Under a second broad aspect, the invention provides a protection device for use with the remote-controlled braking system of the train having a locomotive and at least one car, the remote-controlled braking system including a first functional unit for mounting in the locomotive of the train and a second functional unit for mounting in the car. The first functional unit and the second functional unit are operative to establish an RF communication link between them. The first functional unit is operative to transmit to the second functional unit a brake command over the RF communication link to cause the second functional unit to apply the brake of the train. The protection device includes the detector for generating a detector signal when a certain condition occurs. In addition, the detector includes a transmitter to transmit an RF signal for introduction in the RF communication link to cause the second functional unit to apply the brake of the train in response to the reception of a brake command by the second functional unit.

BRIEF DESCRIPTION OF THE DRAWINGS

A detailed description of examples of implementation of the present invention is provided hereinbelow with reference to the following drawings, in which.

Figure 1:
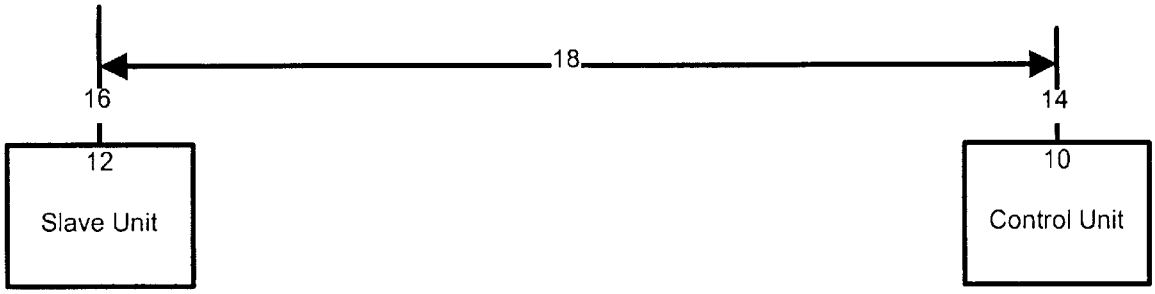
Figure 1 Prior Art
FIG. 1 is a functional block diagram of a remote-controlled braking system according to the prior art.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

FIG. 1 illustrates a prior art remote-controlled braking system for a train. The remote-controlled braking system includes two functional units namely a control unit 10 that is normally mounted in the locomotive of the train and a slave unit 12 that is mounted in a car of the train, typically the last car of the train. In its simplest form of construction, the control unit 10 includes an antenna 14 to transmit signals over an RF communication link 18 to an antenna 16 of the slave unit 12. The main purpose of the remote-controlled brake system is to allow the control unit 10, under certain emergency conditions, to issue over the RF link 18 a brake command signal which is received by the slave unit 12 and implemented to apply the brakes of the train on the car on which the slave unit 12 is mounted.

Note that the train may comprise a locomotive without any cars attached thereto. In this situation, the control unit 10 may be mounted in the locomotive of the train while the slave unit 12 may be mounted at some other location on the train. In a specific example, the slave unit 12 is coupled to the brake line located outside the locomotive cab.

Figure 2:
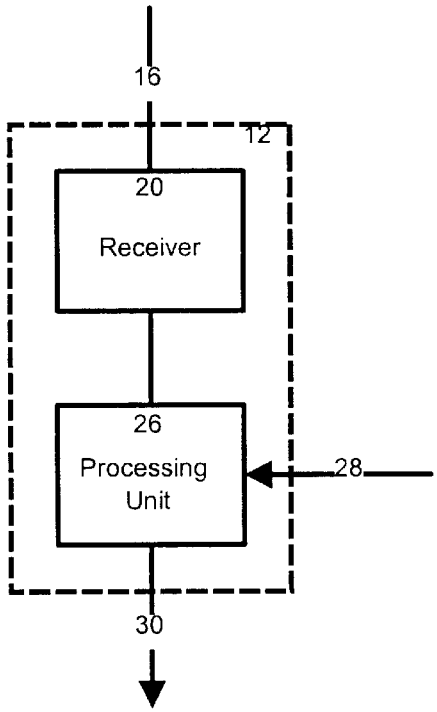
Figure 2 Prior Art
FIG. 2 is a block diagram of the slave unit of the remote-controlled braking system shown in FIG. 1.

FIG. 2 provides a more detailed block diagram of the slave unit 12. The slave unit 12 includes a receiver 20 that is connected to the antenna 16 and that receives the electrical signal generated by the antenna 16 when the antenna 16 picks up a transmission over the RF communication link 18. The output of the receiver 20 is passed to a processing unit 26 that determines what action needs to be taken in dependence upon the message that is being received over the RF communication link 18.

If the message that is being received indicates that the brake of the train must be applied, the processing unit 26 will issue at its output 30 a signal that will cause the brake application. Practically, this signal is directed to a solenoid that, when energized, will relieve the air pressure in a brake line causing automatic application of the brakes.

Under a possible variant, the processing unit 26 is designed to receive input signals from sensors such as to detect an emergency condition. In the example shown in FIG. 2, the processing unit 26 has been input with signal 28 that measures, for the sake of this example, the air pressure in a brake reservoir. When the processing unit 26 determines that the air pressure is below a certain threshold, it generates a signal and transmits this signal over the RF communication link 18. This is effected by a transmitter that is not shown in FIG. 2 for the sake of simplicity.

Figure 3:
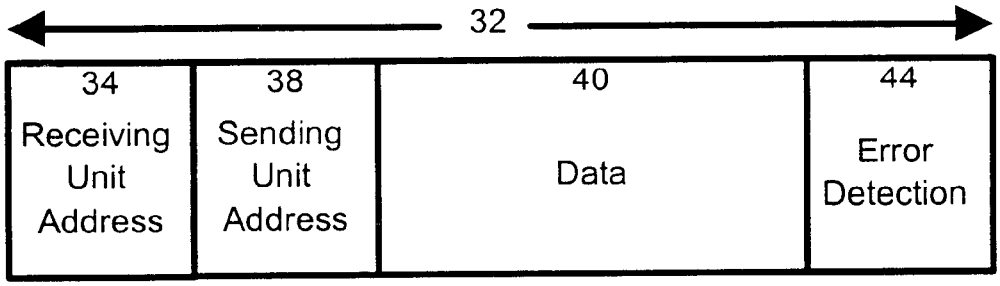
Figure 3 Prior Art
FIG. 3 illustrates the structure of a data packet sent from the control unit to the slave unit of the remote-controlled braking system of FIG. 1.

The nature of the communication protocol over the RF communication link 18 may vary. Under one possibility, the signal sent over the RF communication link 18 is frequency modulated where a different frequency identifies a different command or message. In particular, when a brake command is to be sent to the slave unit 12, the control unit 10 generates a signal of a particular frequency which, when recognized by the slave unit 12, causes the application of the brake. Another possibility is to use digitally encoded messages where each message is a collection of bits. The bits may be transmitted by different techniques over the RF communication link 18, one possible example being the frequency shift keying (FSK). Another possible approach is to use a communication protocol in which the bits are arranged according to a certain data packet structure. An example of such a data packet is shown in FIG. 3. The data packet 32 includes four different fields namely a receiving unit address 34, a sending unit address 38, a data field 40 and an error detection field 44. The receiving unit address field 34 contains an identifier that uniquely identifies the slave unit 12. Similarly, the sending unit address 38 contains data that uniquely identifies the control unit 10. This addressing scheme is useful in circumstances where several trains may operate in proximity of one another and where it is important to ensure that the control message sent from the control unit from one train is not accidentally implemented by the slave unit of another train.

For additional information on the structure and operation of the remote-controlled braking systems available in the marketplace, the user is invited to refer to the U.S. Pat. No. 4,641,892 entitled "Railway Emergency Brake System" that has been granted on Feb. 10, 1987 to DSL Dynamic Sciences Limited in Canada. Another reference of interest is the U.S. Pat. No. 4,487,060 granted on Dec. 11, 1984 on the invention entitled "Railway Brake Pressure Monitor" Glenayre Electronics, Ltd. in Canada. The contents of these two U.S. patents are incorporated herein by reference.

A remote-controlled braking system of the type generally described in this specification can be purchased from Union Switch & Signal Inc. in Pittsburgh, Pa., as well as from Westinghouse Airbrake Co. in Wilmerding, Pa.

Figure 4:
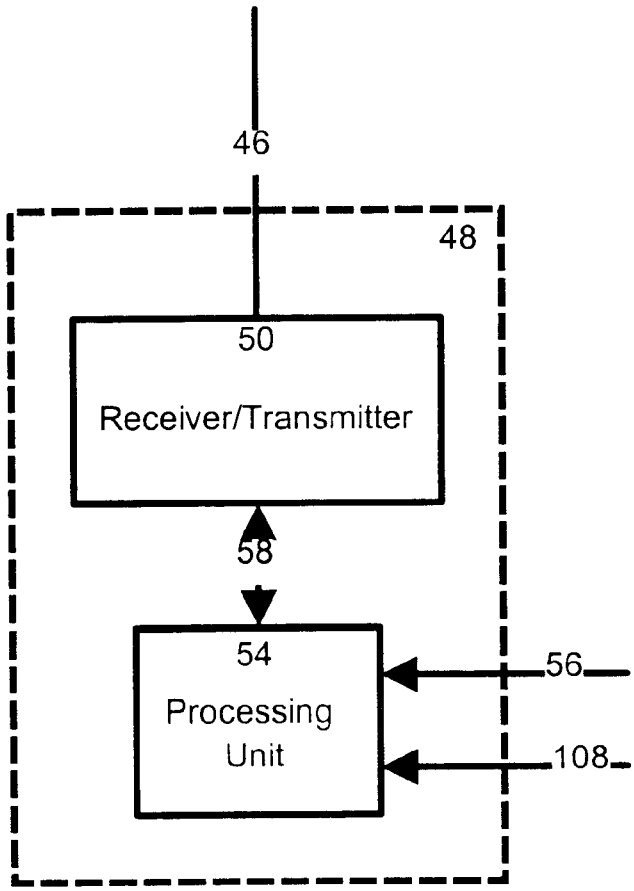
FIG. 4 is a block diagram of the protection device in accordance with the invention

The protection device in accordance with a specific example of implementation of the present invention is depicted in FIG. 4. The protection device 48 includes a receiver/transmitter 50 that is connected to an antenna 46 which is used for the reception and transmission of signals. The receiver/transmitter 50 is coupled to a processing unit 54 that has an input 56 for receiving an external signal.

Figure 5:
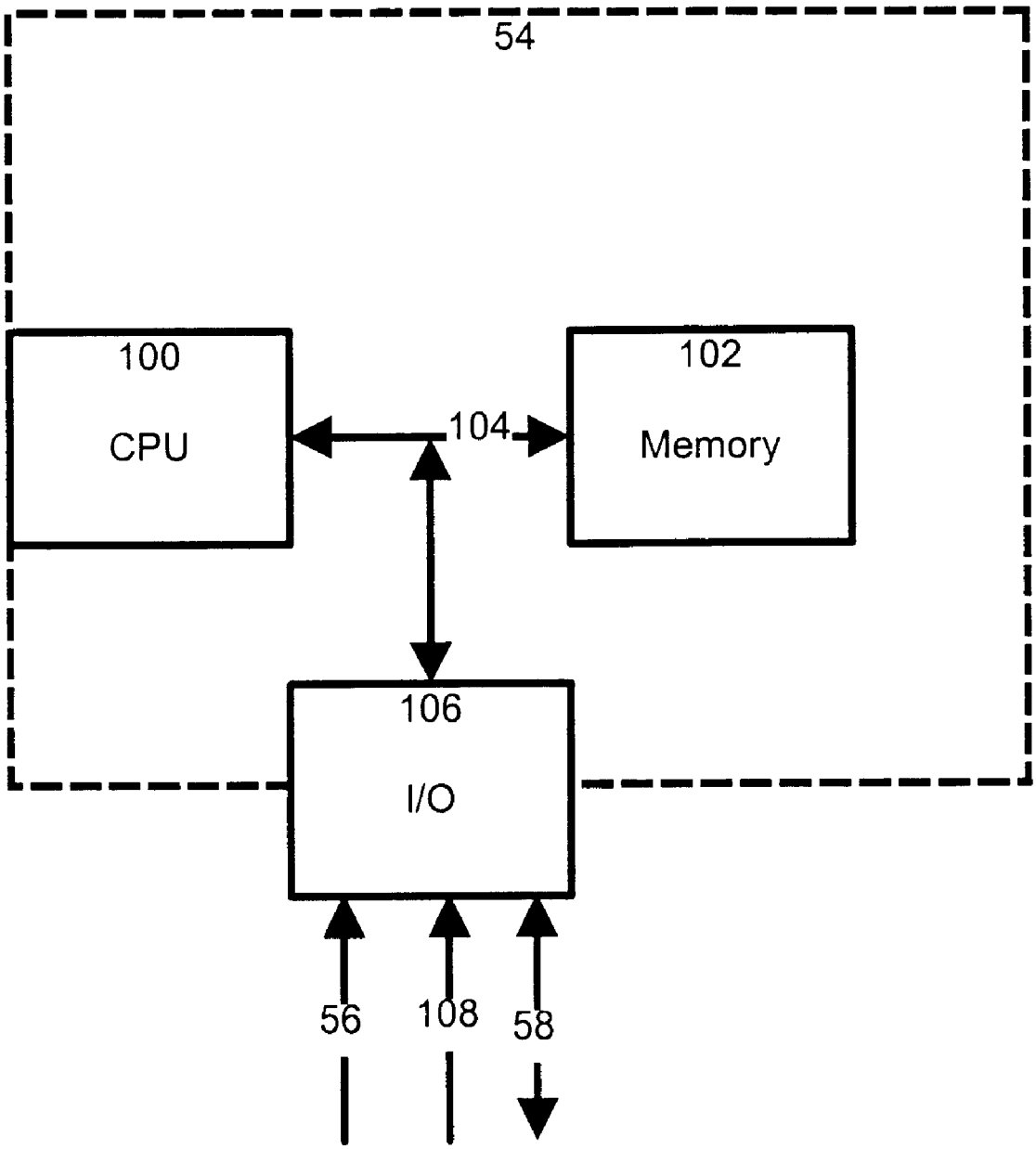
FIG. 5 is a block diagram of the processing unit of the protection device depicted in FIG. 4.

The structure of the processing unit 54 is shown in FIG. 5. The processing unit 54 has a central processing unit 100 that connects with a memory 102 over a bus 104. An input/output (I/O) interface 106 connects with the data bus 104. The I/O interface 106 allows the CPU 100 to receive and send messages and signals with the external world. In particular, signals received and sent to the receiver/transmitter 50 transit through the I/O interface 106. Also, the external signal 56 is transmitted to the CPU 100 for processing through the I/O interface 106.

The purpose of the external signal 56 is to act as a trigger in order to initiate the operation of the protection device 48. In particular, the external signal 56 is generated from a detector that senses when the train is about to enter a forbidden zone or boundary. In one possible form of implementation, the signal 56 is generated by a detector that is installed adjacent to railroad tracks and that is designed to sense the presence of the train. Assume for the sake of this example that the boundary that the train should not be crossing is identified by a traffic light. When the traffic light indicates to the operator of the train that he must stop, the traffic light becomes an area or boundary that the train should not penetrate. The detector issuing a signal 56 is located adjacent this boundary such as to detect when the train is about to cross the boundary. The distance at which the detector is mounted on the railroad tracks should be sufficient to allow the train to be stopped before the boundary is crossed.

Various types of detectors can be used without departing from the spirit of the invention. One type of detector is based on a light beam that is projected across the railroad tracks. The detector includes a light emission station and a light detection station. The light detection station senses the presence of the light beam. When no train passes on the railroad tracks, the light detection station generates a steady signal identifying the presence of the light beam. When the train intercepts the light beam, the light detection station senses this event and generates a signal accordingly.

In conventional railway systems, the detector that detects the position of the train is implemented by an electrical circuit formed of the track rails, a source of signal voltage, a relay energized by the signal voltage and the train itself. The presence of the train shunts the signal voltage, thus releasing the relay and thereby detecting the presence of the train in an allowed track area or its incursion into a forbidden area. Another conventional detector implements wheel counter logic for counting the wheels of the train as it passes by, thus determining when the train has vacated a particular track segment and entered the next one. In another example, the detector is a transponder (a low frequency or radio frequency transmitter and receiver) which replies to a signal from the train when it passes over, by indicating a number or code identifying the position as if it were a signpost.

In general, many different types of detectors can be used without departing from the spirit of the invention. It is well within the reach of the person skilled in the art to select the proper type of detector according to the intended application.

In an alternative example, the external signal 56 is generated from a detector that senses when the train is about to enter a forbidden zone, or cross a boundary, at a speed greater than a maximum allowable speed. The maximum allowable speed corresponds to the maximum train speed that is allowed by the traffic control defined for the particular zone or boundary. In this case, the detector may be implemented by a form of radar gun, for example the radar gun commonly used by the police to detect speeding vehicles.

In the situation when the protection device 48 is designed to be used at or near a traffic light signal, a possible refinement is to input in the processing unit 54 a signal from the traffic light that would indicate where the traffic light is such that the train must stop. This avoids unintentional operation of the protection device when the traffic light indicates that the train may pass through the boundary. This additional signal is identified by reference numeral 108 in FIG. 4.

Under a possible variant, the protection device 48 is mounted on the train itself and it receives information regarding the position of the train with relation to a forbidden zone or boundary through a global positioning system (GPS). Such GPS systems are well known in the art and do not need to be described here in detail. Suffice it to say that the GPS system receives data from satellites allowing determining the precise position of the train. In the memory of the device is a map that identifies the areas that the train should not enter, or the boundaries that the train should not cross, without specific authorization. Constantly, the system compares the actual position of the train with reference to the forbidden zones or boundaries to determine when the signal 56 directed to the processing unit 54 is to be emitted.

Figure 6:
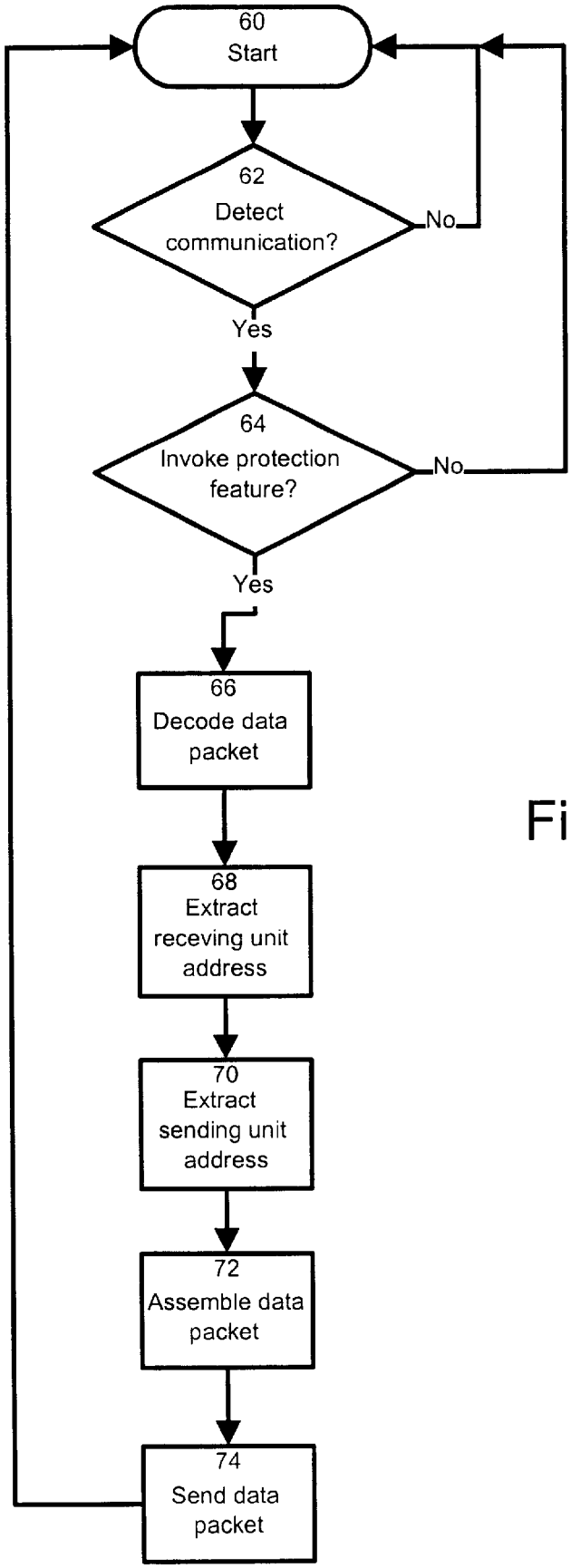
FIG. 6 is a flowchart that illustrates the operation of the protection device illustrated in FIG. 4.

FIG. 6 of the drawings is a flow chart illustrating the operation of the system. The procedure starts at step 60. At conditional step 62, the protection device 48 determines if commutation over the RF communication link 18 is sensed. This step is necessary when the communication protocol over the RF link 18 is based on data packets of the type illustrated in FIG. 3 which contain an addressing scheme. The protection device 48 first identifies the addresses of the sending unit ends of the receiving unit such as to properly construct the brake command signal. When no such addressing scheme is implemented in the remote controlled braking system of the train, there is no necessity for the protection device 48 to monitor the commutation over the RF communication link 18. In this latter case, the protection device 48 has all the information necessary in order to construct a brake command signal for introduction in the RF link 18.

The actual detection of messages over the RF link 18 is performed by the receiver section of the receiver/transmitter 50. There is no need to describe this component in detail since its structure and operation are well known to a person skilled in the art.

If the answer to the conditional step 62 is negative, in other words there is no commutation sensed, the procedure returns to the entry step 60. If the answer to the conditional step 62 is affirmative, then the procedure executes a conditional step 64 which determines whether the protection feature offered by the protection device 48 should be implemented. Practically, the conditional step 64 is answered in the negative or in the affirmative depending on whether a signal 56 from the detector is present (indicating presence of the train) and, alternatively, if a signal one awaits from the traffic light is present (implying that the traffic light indicates the train to stop). If the protection feature is not to be invoked, the procedure returns to entry step 60. Otherwise, if the protection feature is to be invoked, the processing unit 54 will decode the data packet 32 sensed earlier. At step 68, the processing unit 54 will extract from the data packet 32 the receiving unit address 34. At step 70, the processing unit 54 will extract from the data packet 32 the sending unit address 38. At step 72, a new data packet 32 is assembled based on the sending unit dress 38 and the receiving unit address 34. In the data field 40 of this new data packet 32, the processing unit 54 inserts data that indicates to the slave unit 12 (receiving unit) to stop. In addition, the processing unit 54 will place in the error detection field 44 any suitable error detection data.

The data packet 32 is then passed to the receiver/transmitter unit 50 which will transmit the signal through the antenna 46. This signal is designed to enter the RF communication link 18 and to be sensed by the slave unit 12. The slave unit 12 will interpret this command as if it originated from the control unit 10 and will implement the brake command thereby causing the braking action to be initiated.

In an alternative form of construction, the data packet 32 sent by the protection device 48 may not contain a brake command, rather it contains data that is interpreted by the control unit 10 to simulate an emergency condition reported by the slave unit 12. When the control unit 10 is designed to respond to this emergency condition by the application of the brake command, the control unit 10 will issue such a brake command over the RF link 18 and produce the same effect, which is the stopping of the train.

The functionality of the protection device 48 as illustrated in FIG. 6 is implemented by software which is executed by the CPU 100. More particularly, the software is a set of instructions which are normally loaded into the memory 102 and executed by the CPU 100.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A protection device for use with a remote controlled braking system of a train having a locomotive, the remote controlled braking system including:

a) a first functional unit for mounting in the locomotive of the train;

b) a second functional unit for mounting on the train, the first unit and the second unit being operative to establish an RF communication link therebetween;

c) the first functional unit being operative to transmit to the second functional unit a brake command over the RF link to cause the second functional unit to apply a brake of the train;

d) said protection device being remote from the train and including:

i) a transmitter operative to transmit an RF signal indicative of a brake command over the RF link to the second functional unit, said second functional unit being responsive to receipt of the brake command from said transmitter to apply the brake of the train.

2. A protection device as defined in claim 1, wherein said transmitter is operative to transmit the RF signal in response to a signal issued by a detector indicating occurrence of a certain condition.

3. A protection device as defined in claim 2, including an input for receiving the signal issued by the detector.

4. A protection device as defined in claim 3, wherein the certain condition is incursion of the train into a certain zone.

5. A protection device as defined in claim 4, wherein the certain condition is incursion of the train into a certain zone at a speed greater than a maximum allowable speed.

6. A protection device as defined in claim 4, wherein said protection device includes:

a) a receiver;

b) a processing unit, said receiver and said transmitter being coupled to said processing unit;

c) said receiver being operative to sense a signal generated from one of the functional units and transmitted toward the other of the functional units over the RF link;

d) the signal recited in (c) implementing a data packet including a first identifier portion identifying the first functional unit and a second identifier portion identifying the second functional unit;

e) said processing unit being operative to decode the data packet and extract the first identifier portion and the second identifier portion;

f) said processing unit being operative to generate a data packet indicative of a brake command conveying the first identifier portion and the second identifier portion g) said processing unit being operative to communicate the data packet indicative of a brake command to said transmitter;

h) said transmitter being operative to transmit an RF signal such as to introduce in the communication link the data packet indicative of a brake command.

7. A protection device as defined in claim 6, wherein said processing unit includes a CPU in operative relationship with a memory.

8. A protection device for use with a remote controlled braking system of a train having a locomotive, the remote controlled braking system including:

a) a first functional unit for mounting in the locomotive of the train;

b) a second functional unit for mounting on the train, the first unit and the second unit being operative to establish an RF communication link therebetween;

c) the first functional unit being operative to transmit to the second functional unit a brake command over the RF link to cause the second functional unit to apply a brake of the train;

d) said protection device being remote from said train and including:

i) a detector for generating a detector signal when a certain condition occurs;

ii) a transmitter responsive to the detector signal to transmit an RF signal indicative of a brake command over the RF link to the second functional unit, said second functional unit being responsive to receipt of the brake command from said transmitter to apply the brake of the train.

9. A protection device as defined in claim 8, wherein the certain condition is incursion of the train into a certain zone.

10. A protection device as define in claim 8, wherein the certain condition is the incursion of the train into a certain zone at a speed greater than a maximum allowable speed.

11. A protection device as defined in claim 9, wherein said detector includes a GPS locator.

12. A protection device as defined in claim 8, wherein said transmitter is operative to transmit the RF signal in response to a signal issued by a detector indicating occurrence of a certain condition.

13. A protection device as defined in claim 12, wherein said protection device includes:

a) a receiver;

b) a processing unit, said receiver and said transmitter being coupled to said processing unit;

c) said receiver being operative to sense a signal generated from one of the functional units and transmitted toward the other of the functional units over the RF link;

d) the signal recited in (c) implementing a data packet including a first identifier portion identifying the first functional unit and a second identifier portion identifying the second functional unit;

e) said processing unit being operative to decode the data packet and extract the first identifier portion and the second identifier portion;

f) said processing unit being operative to generate a data packet indicative of a brake command conveying the first identifier portion and the second identifier portion g) said processing unit being operative to communicate the data packet indicative of a brake command to said transmitter;

h) said transmitter being operative to transmit an RF signal such as to introduce in the communication link the data packet indicative of a brake command.

14. A protection device as defined in claim 13, wherein said processing unit includes a CPU in operative relationship with a memory.

15. A protection device for use with a remote controlled braking system of a train having a locomotive, the remote controlled braking system including:

a) first means for receiving and transmitting RF signals, said first means adapted to be mounted in the locomotive of the train;

b) second means for receiving and transmitting RF signals, said second means adapted to be mounted on the train, the first means and the second means being operative to establish an RF communication link therebetween;

c) the first means being operative to transmit to the second means a brake command over the RF link to cause the second means to apply a brake of the train;

d) said protection device being remote from the train and including:

i) transmitter means operative to transmit an RF signal indicative of a brake command over the RF link to the second means, said second means being responsive to receipt of the brake command from said transmitter means to apply the brake of the train.

* * * * *